US009315042B2

(12) United States Patent
Adamic

(10) Patent No.: US 9,315,042 B2
(45) Date of Patent: Apr. 19, 2016

(54) SYSTEMS FOR ERASING AN INK FROM A MEDIUM

(75) Inventor: Raymond Adamic, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/114,958

(22) PCT Filed: Jul. 29, 2011

(86) PCT No.: PCT/US2011/046038
§ 371 (c)(1),
(2), (4) Date: Oct. 31, 2013

(87) PCT Pub. No.: WO2012/166161
PCT Pub. Date: Dec. 6, 2012

(65) Prior Publication Data

US 2014/0055540 A1 Feb. 27, 2014

Related U.S. Application Data

(63) Continuation-in-part of application No. PCT/US2011/039025, filed on Jun. 3, 2011, which is a continuation-in-part of application No. PCT/US2011/039014, filed on Jun. 3, 2011, which is a continuation-in-part of application No. PCT/US2011/039023, filed on Jun. 3, 2011.

(51) Int. Cl.
*B41J 2/01* (2006.01)
*B41J 2/21* (2006.01)
(Continued)

(52) U.S. Cl.
CPC .... *B41J 2/21* (2013.01); *B41J 2/17* (2013.01); *B41J 11/0015* (2013.01)

(58) Field of Classification Search
CPC ..... B41J 29/26; B41J 29/36; B41J 29/367; B41J 29/373
USPC ..... 347/101
See application file for complete search history.

(56) References Cited

U.S. PATENT DOCUMENTS 2,960,558 A * 11/1960 Kordesch et al. ..... 429/63
4,261,799 A 4/1981 Anizan et al.
(Continued)

FOREIGN PATENT DOCUMENTS

EP 0118004 9/1984
EP 0446564 11/1990
(Continued)

OTHER PUBLICATIONS

N. Madison, What is an Electrode?, Feb. 1, 2015, www.wisegeek.org/what-is-an-electron.htm.*
(Continued)

*Primary Examiner* — Shelby Fidler
*Assistant Examiner* — Tracey McMillion
(74) *Attorney, Agent, or Firm* — Dierker & Associates, P.C.

(57) ABSTRACT

A system for erasing an ink from a medium includes the medium having the ink printed on a surface thereof, and an erasure fluid directly or indirectly applied to the surface. The system further includes an inert base upon which the medium is placed, and an electrochemical cell. The electrochemical cell includes a cathode and an anode, both positioned adjacent the surface of the medium having the ink printed thereon, and a power source to apply a voltage across the medium.

13 Claims, 5 Drawing Sheets

(51) Int. Cl.
*B41J 11/00* (2006.01)
*B41J 2/17* (2006.01)

(56) References Cited

U.S. PATENT DOCUMENTS

| | | | | |
|---|---|---|---|---|
| 4,874,537 | A | | 10/1989 | Peterson et al. |
| 4,954,174 | A | | 9/1990 | Imagawa |
| 4,960,464 | A | | 10/1990 | Chen |
| 5,281,358 | A | | 1/1994 | Urushibata et al. |
| 5,507,926 | A | | 4/1996 | Keller et al. |
| 5,568,986 | A | * | 10/1996 | Sugai ..... 400/695 |
| 5,607,063 | A | * | 3/1997 | Nishijima ..... B07C 3/00 209/584 |
| 5,643,409 | A | | 7/1997 | Hamaguchie et al. |
| 5,711,791 | A | | 1/1998 | Croker et al. |
| 5,852,073 | A | | 12/1998 | Villiger et al. |
| 6,013,122 | A | | 1/2000 | Klitzman et al. |
| 6,030,519 | A | | 2/2000 | Keller et al. |
| 6,110,883 | A | | 8/2000 | Petri et al. |
| 6,163,673 | A | | 12/2000 | Shindo |
| 6,436,342 | B1 | | 8/2002 | Petri et al. |
| 6,444,021 | B1 | | 9/2002 | Weisbecker et al. |
| 6,544,601 | B1 | | 4/2003 | Kong |
| 6,783,657 | B2 | | 8/2004 | Marsh et al. |
| 6,905,539 | B2 | | 6/2005 | Patel et al. |
| 7,192,335 | B2 | | 3/2007 | Lee et al. |
| 7,192,911 | B2 | | 3/2007 | Sunder et al. |
| 7,767,057 | B2 | | 8/2010 | Rosencrance et al. |
| 2003/0119687 | A1 | | 6/2003 | Chikosi |
| 2004/0225032 | A1 | | 11/2004 | Spencer et al. |
| 2005/0003984 | A1 | | 1/2005 | Himmrich et al. |
| 2006/0034984 | A1 | | 2/2006 | Baydo et al. |
| 2006/0089281 | A1 | | 4/2006 | Gibson |
| 2006/0147717 | A1 | | 7/2006 | Hasegawa et al. |
| 2007/0022800 | A1 | | 2/2007 | Zifferer et al. |
| 2007/0049510 | A1 | | 3/2007 | Fujii et al. |
| 2007/0054827 | A1 | | 3/2007 | Cheung |
| 2007/0151945 | A1 | | 7/2007 | Miyamachi et al. |
| 2007/0159517 | A1 | | 7/2007 | Hashimoto et al. |
| 2007/0228005 | A1 | * | 10/2007 | Hasegawa et al. ..... 216/58 |
| 2008/0193725 | A1 | | 8/2008 | De Saint-Romain |
| 2009/0143273 | A1 | | 6/2009 | Cheung |
| 2009/0258156 | A1 | | 10/2009 | Chretien et al. |
| 2009/0325839 | A1 | | 12/2009 | Wortley et al. |
| 2010/0123759 | A1 | | 5/2010 | Matsui et al. |
| 2011/0150950 | A1 | | 6/2011 | Gonzales et al. |
| 2013/0022556 | A1 | | 1/2013 | Gonzales et al. |

FOREIGN PATENT DOCUMENTS

| | | |
|---|---|---|
| EP | 0492224 | 12/1991 |
| JP | 56-040577 | 4/1981 |
| JP | 04-039100 | 2/1992 |
| JP | 2000056497 | 2/2000 |
| JP | 2000154345 | 6/2000 |
| KR | 20090041874 | 4/2009 |
| WO | WO 03/101753 | 12/2003 |
| WO | WO 2007/005063 | 1/2007 |

OTHER PUBLICATIONS

Heinze, Jürgen, "Ultramicroelectrodes in Electrochemistry", Angew. Chem. Int. Ed. Engl., 1993, 32, pp. 1268-1288.

* cited by examiner

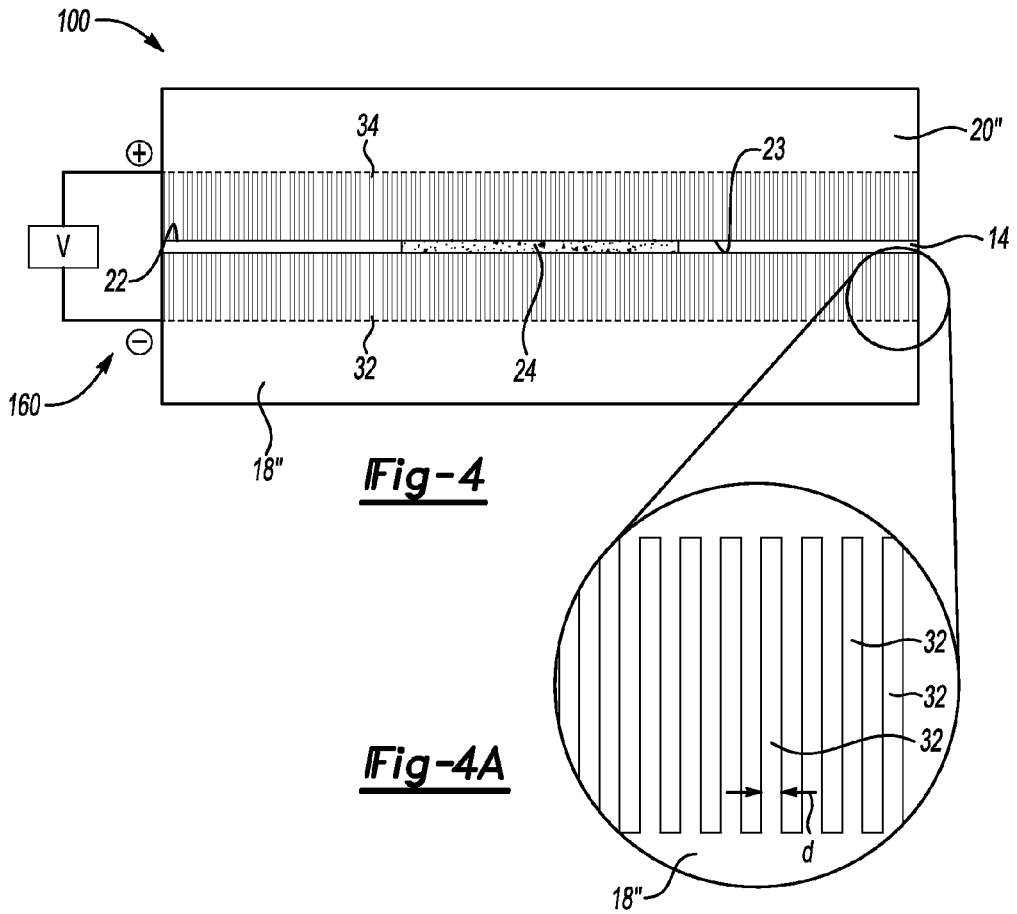
Fig-4
Fig-4A
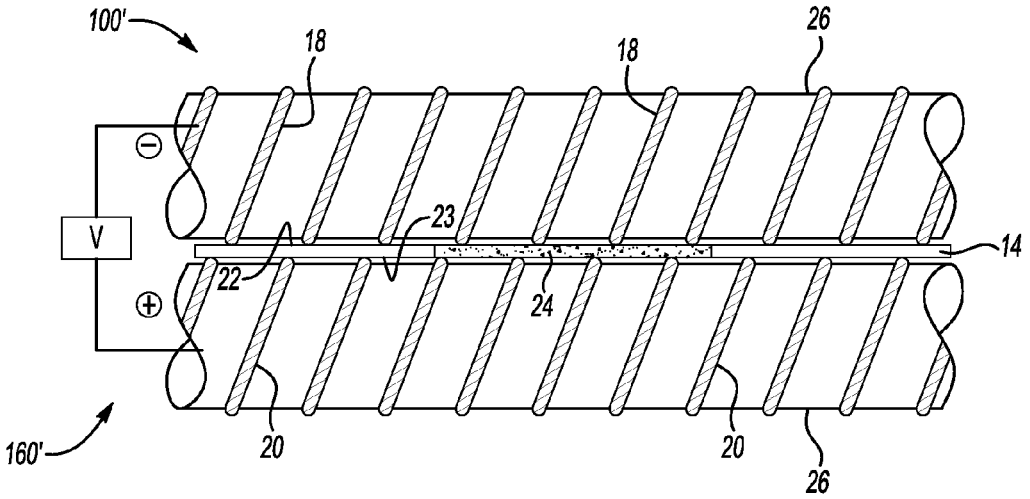
Fig-5

SYSTEMS FOR ERASING AN INK FROM A MEDIUM

CROSS-REFERENCE TO RELATED APPLICATIONS

This application is a Continuation-In-Part of each of: International application Number PCT/US2011/039025, filed Jun. 3, 2011; International application Number PCT/US2011/039014, filed Jun. 3, 2011; and International application Number PCT/US2011/039023, filed Jun. 3, 2011; each of which is incorporated by reference herein in its entirety.

BACKGROUND

The present disclosure relates generally to systems for erasing an ink from a medium.

Inkjet printing is an effective way of producing images on a print medium, such as paper. Inkjet printing generally involves ejecting ink droplets (formed, e.g., from one or more inks) from a nozzle at high speed by an inkjet printing system onto the paper to produce the images thereon. In some instances, it may be desirable to erase the inkjet ink(s) after the ink(s) is/are established on the paper.

BRIEF DESCRIPTION OF THE DRAWINGS

Features and advantages of examples of the present disclosure will become apparent by reference to the following detailed description and drawings, in which like reference numerals correspond to similar, though perhaps not identical components. For the sake of brevity, reference numerals or features having a previously described function may or may not be described in connection with other drawings in which they appear.

FIGS. 4 through 6 are side views schematically depicting examples of another example of a system for erasing an ink from a medium, with FIG. 4A being an enlarged view of a portion of the schematic shown in FIG. 4.

DETAILED DESCRIPTION

Figure 1:
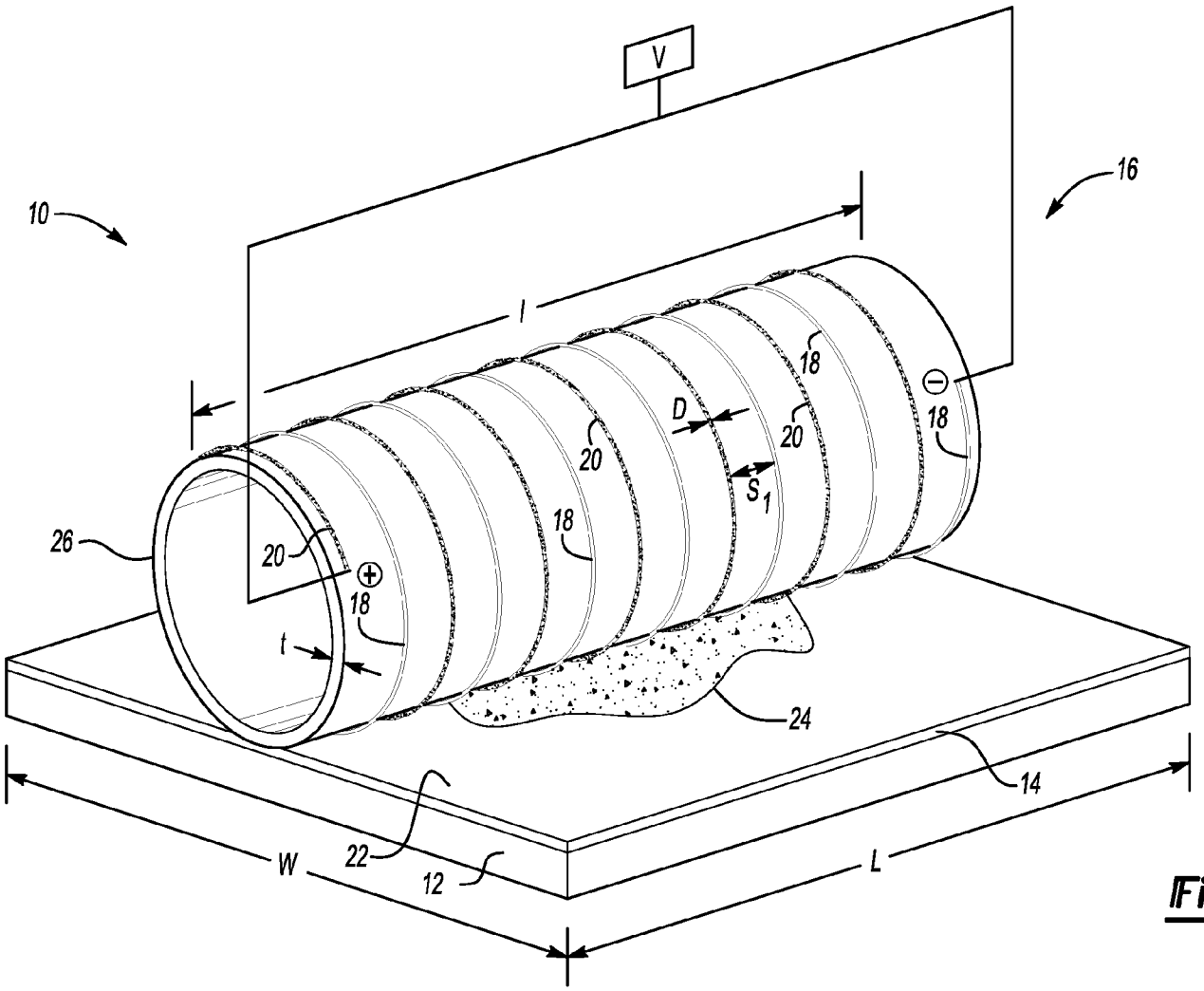
FIGS. 1 through 3 are perspective views schematically depicting examples of one example of a system for erasing an ink from a medium.

Several examples of erasable inkjet inks have previously been described in co-pending PCT Application Ser. No. PCT/US11/39025, which is incorporated herein by reference in its entirety. These inks, when printed on a medium, are specifically formulated to interact with a fluid, such as an erasure fluid, to erase the ink from the medium. Some examples of the erasure fluid that may, in some cases, be used for erasing the erasable inkjet inks have also been previously described in co-pending PCT Application Ser. No. PCT/US11/39025.

The extent to which the erasable inkjet ink may effectively be erased from the medium depends, at least in part, on the ability of the colorant(s) of the erasable inkjet ink to chemically react with erasure component(s) of the erasure fluid. In many instances, this chemical reaction is an oxidation-reduction (redox) reaction, and is considered to be a favorable reaction at least in terms of free energy. However, the reaction may, in some instances, require some additional means to facilitate and/or assist the reaction so that the erasing occurs both effectively (e.g., in terms of erasing) and efficiently (e.g., in terms of time and energy).

The inventor of the instant disclosure has found that an electrochemical cell may be used to facilitate and/or assist the redox reaction occurring between the colorant(s) of the erasable inkjet ink and the erasure component(s) of the erasure fluid selected for the erasing process. Accordingly, example(s) of the system as disclosed herein advantageously include an electrochemical cell that is used as a means to facilitate and/or assist erasing the inkjet ink from medium. It is to be understood that for particular combinations of erasure fluids and erasable inkjet inks, it has been found that the redox reaction may occur spontaneously; e.g., as soon as the erasure fluid contacts the dried ink. In these cases, the example(s) of the system may be used to assist (e.g., to speed up the reaction, to drive the reaction to completion, etc.) the erasing process. For other combinations of erasure fluids and erasable inkjet inks, a reaction between the ink and the fluid may not occur spontaneously when the two (i.e., the ink and the fluid) come into contact with one another. In these cases, the example(s) of the system disclosed herein may be used to facilitate the redox reaction between the fluid and the ink to ultimately erase the ink from the medium.

Again, it is believed that the use of the electrochemical cell in the examples of the system disclosed herein enables erasing of the erasable inkjet ink from the surface of a medium in a more effective and efficient (at least, e.g., in terms of energy) manner. This is compared, for instance, to the use of heaters or other radiation sources. The belief is based, at least in part, on the fact that electrons are directed toward the redox reaction occurring between the colorant(s) of the ink and the erasure component(s) of the erasure fluid utilizing the electrochemical cell, rather than heating or radiating other surfaces, materials, etc. that may result with the use of the heaters or other radiation sources.

The electrochemical cell utilized in each of the examples of the system disclosed herein is formed utilizing two electrodes (e.g., a cathode and an anode) and a fluid (e.g., an erasure fluid) to complete an electrochemical circuit. A power supply or load is used to apply a suitable voltage between the anode and the cathode to facilitate and/or assist the erasing of the ink from the surface of a medium. As previously mentioned, the erasing process generally relies on redox reactions between the erasure component(s) of the erasure fluid and the colorant(s) of the ink. During the redox reaction, the colorant(s) of the ink ultimately change and de-colorize. Further, the erasing of the inkjet ink from the medium utilizing the electrochemical cell occurs very quickly (e.g., from about 10 seconds to about 60 seconds depending, at least in part, on the kinetics of the reaction, the nature of the electrodes, the voltage applied to the medium, and the amount of erasure fluid applied to the medium during erasing) or, in some instances, instantaneously. This is in contrast to erasing without the use of the electrochemical cell which, in some instances, may occur spontaneously, but the erasing may occur over a much longer period of time (e.g., from about 5 minutes up to about 24 hours).

Some examples of the system disclosed herein include an electrochemical cell that is constructed so that the entire cell is located adjacent a single surface of the medium upon which the erasable inkjet ink was established. Thus, during erasing, a voltage (which is applied between the electrodes of the cell) is applied across the surface of the medium. These example systems 10, 10', 10" are described in detail in conjunction with FIGS. 1, 2, and 3, respectively.

Figure 2:
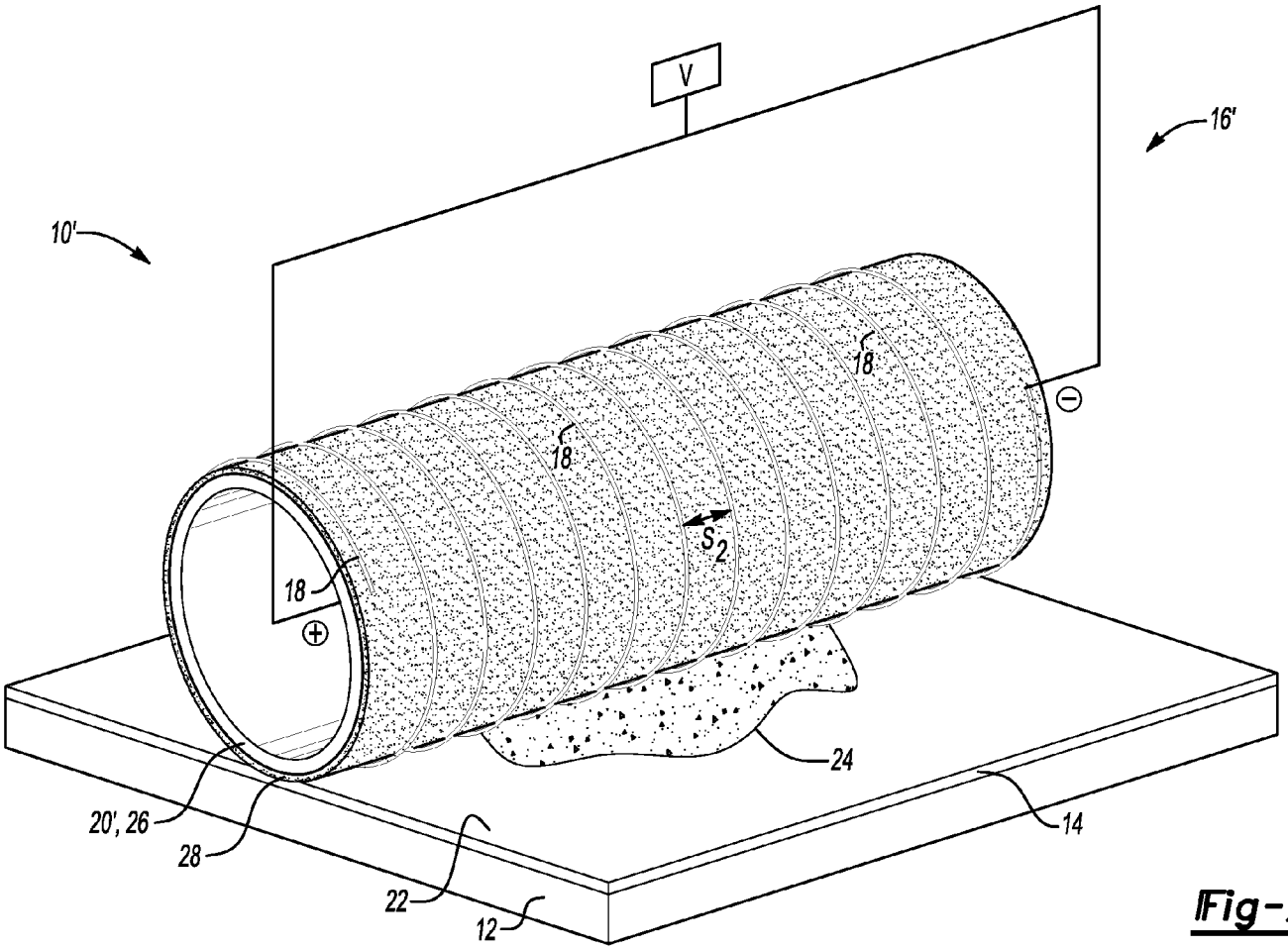
Figure 3:
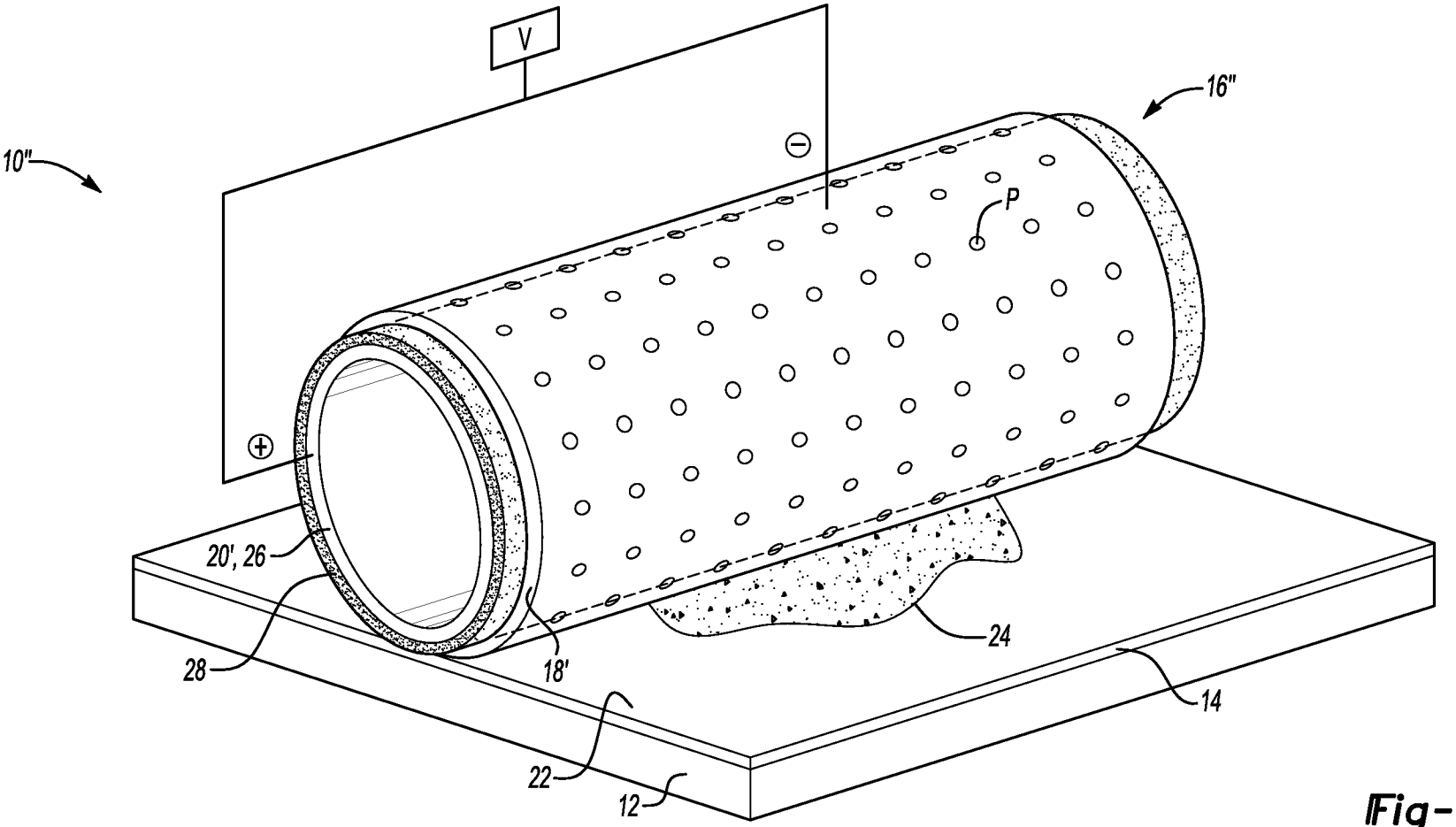

Referring to FIGS. 1, 2, and 3 together, the system 10, 10', and 10", respectively, includes the electrochemical cell (represented by reference numerals 16, 16', and 16" in FIGS. 1, 2, and 3, respectively) includes a cathode (represented by reference numeral 18 in FIGS. 1 and 2; and by reference numeral 18' in FIG. 3) and an anode (represented by reference numeral 20 in FIG. 1; and by reference numeral 20' in FIGS. 2 and 3), each situated on the same side, or adjacent the same surface (e.g., the surface 22) of the medium 14. In other words, the cathode 18, 18' and the anode 20, 20' are next to one another in some configuration (examples of which will be described below), and are positioned adjacent to the dried ink established on the surface 22 of the medium 14. A complete electrochemical circuit may be formed via the cathode 18, 18', the anode 20, 20', an erasure fluid (represented by reference numeral 24 in the figures) applied to the surface 22 of the medium 14 (either directly or indirectly), and a power supply (also referred to herein as load or voltage source V).

Since a voltage may be applied across the surface 22 of the medium 14 utilizing the construction of the electrochemical cell 16, 16', 16", the erasure fluid 24 need only be present at the surface 22 (or perhaps absorbed slightly into the medium 14, but not through it). This reduces the amount of erasure fluid 24 required to be applied to the medium 14 in order to complete the electrochemical circuit and to drive the redox reaction(s) occurring between the ink and the fluid 24. In other words, having the cathode 18, 18' and the anode 20, 20' positioned on the same side of the medium 14 reduces the distance between the cathode 18, 18' and the anode 20, 20' so that the necessary redox reaction(s) occurring between the erasure fluid 24 and the ink occurs across the surface 22 of the medium 14, rather than through the medium 14.

The amount of erasure fluid 24 to be applied to the medium 14 in these examples of the system is such that the erasure fluid 24 does not have to penetrate all of the way through the thickness of the medium 14. In an example, at least 50% less fluid needs to be applied to the medium 14 in order to complete the electrochemical circuit for the examples shown in FIGS. 1, 2, and 3 compared to those configurations where the fluid has to penetrate through the medium 14 in order to complete the electrochemical circuit. The reduced amount of erasure fluid 24 to be applied to the medium 14 improves the efficiency of the erasing process, as well as maintains the integrity and/or durability (e.g., in terms of curl and cockle) of the medium 14. The medium 14 may thus be reused after the erasing is complete. The reduced amount of fluid also enables the overall size of the system 10, 10', 10" to be reduced, rendering the system 10, 10', 10" as usable in applications that are as small as those falling within the millimeter scale (e.g., applications that are as small as 5 millimeters to 10 millimeters in size). It is to be understood that the overall size of the system 10, 10', 10" may also be larger for use in applications that are larger than those that are 10 millimeters in size.

Referring now to FIG. 1, one example of the system 10 includes an inert base 12 upon which the medium 14 (having the ink printed thereon) is placed. It is to be understood that the medium 14 shown in FIG. 1 (as well as the medium 14 shown in the other figures of the present disclosure) is not drawn to scale. In instances where the medium 14 is paper, the medium 14 may actually be much smaller in thickness than shown in the figures relative to the base 12 upon which the medium 14 is placed.

The medium 14 may be placed so that a non-printed side or surface (i.e., the side of the medium 14 from which erasing is not desired) faces downwardly; i.e., adjacent to the base 12. The inked side or surface 22 (i.e., the side of the medium 14 from which erasing is desired) faces upwardly; i.e., opposite from the base 12. If erasing is accomplished outside of a printer (e.g., in a standalone erasing apparatus, device, or the like), the base 12 may be formed from any inert material that will i) suitably support the medium 14 when placed thereon and ii) provide a surface enabling the electrodes of the electrochemical cell 16 to compress against the medium 14 during erasing. Some examples of the base 12 may include a piece of wood, plastic (e.g., polyacrylic, polyurethane, etc.), fiberglass, an elastomer or rubber having an appropriate durometer, or the like. If, however, erasing is accomplished inside a printer (e.g., as part of an inkjet printer), the base 12 may be a platen or other component of the printer for supporting the medium 14 during printing (except, in this case, during erasing). In this case, the base 12 may be formed from any material that may be used to form the platen in a printer, such as polyacrylic or other plastics commonly used in printing systems. In some instances, the base 12 may also be a non-flat surface, such as a roller incorporated into the printer.

The base 12 may, in an example, have a length L and width W that is substantially the same, or is the same as the length and width of the medium 14 placed thereon, as shown in FIG. 1. This configuration may be found in both standalone apparatuses, as well as inside various printing systems (i.e., printers). In this configuration, the edges of the medium 14 line up with the edges of the base 12 when the medium 14 is placed on the base 12, and the medium 14 may be secured to the base 12, e.g., utilizing star wheels, pinch rollers, or even static charges in instances where a platen formed of plastic or other similar material capable of electrostatic charge generation is used. The base 12 may otherwise be larger in length L and width W than the length and width of the medium 14 (not shown in the figures). In this configuration, the positioning of the medium 14 on the base 12 may be measured so that the medium 14 is properly lined up with the electrochemical cell 16 (via, e.g., guide rollers or other printer alignment mechanisms commonly used in printers).

The erasure fluid 24 may be applied to the surface 22 of the medium 14 (i.e., the surface having the image formed thereon) once the medium 14 has been placed on the inert base 12. In an example, the erasure fluid 24 is directly applied to the surface 22 of the medium 14. The direct application of the fluid 24 to the medium 14 may be accomplished, in one example, via an inkjet printing process (e.g., thermal inkjet printing or piezoelectric inkjet printing), e.g., by ejecting the fluid 24 onto the surface 22 using a fluid ejector of an inkjet printing system (not shown). More specifically, the printing system may include a printing device including a fluid ejector (in addition to other fluid ejectors for ejecting the ink onto the medium during a printing process) that is fluidically coupled to a reservoir that contains the erasure fluid 24. The fluid ejector is configured to eject the fluid 24 onto the surface of the medium 14 (upon feeding the medium 14 through the printing device), where the erasure fluid 24 is retrieved from the reservoir during an erasing process involving the inkjet printing of the erasure fluid 24 onto the medium 14. It is to be understood that, in practice, the medium 14 generally would not be printed via the ejector for ejecting the ink and then erased directly thereafter via ejecting the erasure fluid 24 from the other fluid ejector. Rather, the printing and the erasing steps generally take place at different times. Further, erasing may or may not be accomplished via the same or a similar device as with the printing.

In another example, the erasure fluid may be directly applied to the medium 14 during a post-processing coating process (not shown). For instance, the medium 14 may be fed into a post-processing coating apparatus, such as, e.g., a roll coater, and a thin (e.g., ranging from about 1 micron to about 15 microns) layer or film of the erasure fluid 24 may be applied directly to the medium 14 as the medium 14 passes through the roll coater. This roll coating apparatus may be incorporated into a printing system, (e.g., the medium 14 may be fed back into a printing system, bypasses a fluid ejector, and the erasure fluid 24 is applied via a roll coater), or be separate from a printing system utilized to form images on the medium 14. In the latter case, the medium 14 may be fed into a standalone roll coating apparatus.

The roll coating apparatus generally roll coats the erasure fluid 24 onto the medium 14 to cover the ink printed thereon. The roll coater may, in one example, be configured to perform a gravure coating process, which utilizes an engraved roller running along a coating bath containing the erasure fluid 24. The engraved roller dips into the bath so that engraved markings on the roller are filled with the erasure fluid 24, and the excess fluid on the roller is wiped away using, e.g., a doctor blade. The fluid 24 is applied to the medium 14 as the medium 14 passes between the engraved roller and a pressure roller.

Other roll coating processes that may be used include reverse roll coating (which utilizes at least three rollers to apply the erasure fluid 24 to the medium 14), gap coating (where fluid applied to the medium 14 passes through a gap formed between a knife and a support roller to wipe excess fluid 24 away from the medium 14), Meyer Rod coating (where an excess of fluid 24 is deposited onto the medium 14 as the medium 14 passes over a bath roller, the Meyer Rod wiping away excess fluid 24 so that a desired quantity of fluid 24 remains on the medium 14), dip coating (where the medium 14 is dipped into a bath containing the fluid 24), and curtain coating.

Yet another way of directly applying the erasure fluid 24 to the medium 14 involves spraying the fluid 24 (e.g., from a sprayer device, not shown) onto the medium 14 (e.g., as an aerosol). The sprayer device may generally include an aerosol generating mechanism and/or an air brush sprayer mechanism. A control mechanism associated with the sprayer device may selectively control the delivery of the type of drops and the spray characteristics, such as, e.g., fine mist to fine bubbles to larger size droplets.

In another example, the erasure fluid 24 may be indirectly applied to the surface 22 of the medium 14. This may be accomplished, for instance, by coating the surfaces of the electrodes (e.g., the cathode and the anode) via any of the roll coating or spraying methods previously described. During the erasing process, the erasure fluid 24 transfers from the surface of the electrodes to the surface 22 of the medium 14 when the electrodes contact the medium 14. In an example, the electrodes are configured to rotate or move in a desirable manner to transfer the erasure fluid 24 to the surface 22 of the medium 14. In another example, the base 12 is configured to move, which causes the medium 14 to move against the electrodes to transfer the fluid 24 to the surface 22 of the medium 14. Further, the amount of fluid 24 to be transferred to the medium 14 may be a predetermined amount. For instance, the roll coating apparatus may be pre-programmed to apply a particular amount of fluid 24 to the medium 14 or to the electrode, depending on whether the fluid 24 is being directly or indirectly applied.

The electrochemical cell 16 shown in FIG. 1 includes a cathode 18 and an anode 20, both positioned adjacent to the surface 22 of the medium 14 upon which the ink is formed, and upon which the erasure fluid 24 is directly or indirectly applied. In this configuration, the entire electrochemical cell 16 is positioned at a single side of the medium 14; i.e., adjacent to the surface 22. In the example shown in FIG. 1, the cathode 18 and the anode 20 are individually conductive or semi-conductive wires wound around a non-conductive support 26 in an alternating configuration. As used herein, the term "wire" refers to a pliable material in the form of a strand, rod, or other like configuration.

The support 26 may be a cylinder (as shown in FIG. 1), a box, a prism, a flat object or surface, or any geometrically shaped support enabling the cathode wire 18 and the anode wire 20 to both be effectively wound around the support 26. The support 26 also includes a length l that may be the same as the length L of the inert base 12 upon which the medium 14 is placed, or may be smaller than the length L depending, at least in part, on the size of the medium 14 and/or the surface area of inked portion of the medium 14 (i.e., the portion of the medium 14 upon which the ink was printed). Further, the support 26 may be solid, or may be hollow having a thickness t. The thickness t may be as thick or as thin as desired, but should be thick enough to properly support the wires 18, 20 wound around the support 26. Further, the effective diameter of the support 26 (measured from the center to the outer surface of the support 26) may vary depending, at least in part, on the application for which the system 10 is being used. In some instances, the effective diameter of the support 26 is small, but larger than a millimeter. In one example, the effective diameter of the support 26 ranges from about 5 mm to about 25 mm.

As previously mentioned, the cathode wire 18 and the anode wire 20 may be chosen from conductive and/or semi-conductive materials. In one example, the cathode wire 18 and the anode wire 20 may be chosen from a transition metal (such as, e.g., copper, iron, tin, titanium, platinum, zinc, nickel, and silver), an electrolytic metal (e.g., aluminum), and/or a metal alloy (e.g., stainless steel). The cathode wire 18 and anode wire 20 may also be chosen from galvanized metals and plated metals (such as those plated with a material to protect against corrosion, etc.).

As shown in FIG. 1, the cathode wire 18 and the anode wire 20 are wound around the support 26 in an alternating configuration (i.e., each winding of the respective wires 18, 20 alternate from one to the other), leaving a spacing $S_1$ between adjacent wires 18, 20. In this configuration, each winding of the cathode wire 18 and the anode wire 20 is considered to be a separate electrode, and thus the electrochemical cell 16 includes a plurality (e.g., tens or hundreds depending on the number of windings of the respective wires 18, 20) of individual electrodes. The spacing $S_1$ between adjacent wires 18, 20 depends, at least in part, on the thickness of the individual wires 18, 20 and/or the gauge of the wires 18, 20. The wires 18, 20, when wound around the support 26, may have a spacing $S_1$ ranging from about 0.01 mm to about 1 mm depending on the thickness and/or the gauge of the wires 18, 20. In one example, the spacing $S_1$ is equivalent to the diameter D of the wires 18, 20, assuming that the wires 18, 20 each have the same diameter D. For instance, a 50 gauge (American Wire Gauge, AWG) wire (which has a 0.025 mm diameter) for the cathode wire 18 and the anode wire 20 may require a spacing $S_1$ of about 0.025 mm between adjacent wires 18, 20. In another example, the spacing $S_1$ between adjacent wires 18, 20 is about the same as the thickness of an individual sheet of paper, or smaller. In an example, the thickness of a single sheet of office plain paper ranges from about 0.08 mm to about 0.12 mm. Without being bound to any theory, it is believed that a smaller spacing $S_1$ between adjacent wires 18, 20 produces a more effective electrochemical circuit for erasing. In instances where the spacing $S_1$ is about 0.025 mm or smaller, the cathode 18 and anode 20 may each be considered to be microelectrodes.

Each winding of the cathode wire 18 and the anode wire 20 is desirably as close to one another as possible without the wires 18, 20 physically touching one another to prevent the circuit from shorting out. Since the electrochemical cell 16 includes a plurality of individual electrodes, it is to be understood that the electrochemical cell 16 as a whole generally will not fail in the event that a small number of electrode pairs touch and short out.

Further, the number of windings of each wire 18, 20 per 1 mm length l of the support 26 is equal to the length l of the support 26 divided by 4 times the diameter d of the wire for a spacing $S_1$ that is equal to the effective diameter of the wires 18, 20. For the example set forth above, the number of windings for each wire 18, 20 having a 0.025 mm diameter d wound around a support 26 having a length l of about 10 cm is about 1,000 windings.

In some cases, the cathode wire 18 and the anode wire 20 may be chosen from different gauge wires (e.g., the cathode wire may be chosen from a 50 gauge wire, and the anode wire may be chosen from a 70 gauge wire). A larger cathode wire 18 may be used in instances where a more cathodic presence is desired, while a larger anode wire 20 may be used in instances where a more anodic presence is desired. For instance, a larger diameter cathode wire 18 may be interspersed with a smaller diameter anode wire 20, and this configuration may provide a greater coverage of the surface 22 of the medium 14 by the cathode 18. This configuration may be desirable in cases where the cathode appears to be where most of the erasing takes place. In one example, a cathode wire 18 having an effective diameter of about 0.2 mm may be used with an anode wire 20 having an effective diameter of about 0.02 mm. In this example, the spacing between the wires 18, 20 is about 0.1 mm for a support 26 having a length of about 10 cm with about 238 windings of each of the wires 18, 20.

Additionally, the length of each wire 18, 20 depends, at least in part, on the length L of the support 26 upon which the wires 18, 20 are wound, and the number of windings of the wires 18, 20.

The electrochemical cell 16 further includes a power supply (i.e., a voltage source or load) V, as previously mentioned. The power supply V includes electrical leads attached to the cathode wire 18 and the anode wire 20. Since the cathode wire 18 and the anode wire 20 are both positioned on the same side of the medium 14 (i.e., adjacent to the surface 22), the power supply V supplies a suitable voltage (utilizing DC current, although the power supply V may be configured to use AC current as well) across the surface 22 of the medium 14 during the erasing process.

To remove the erasable inkjet ink from the surface of paper (e.g., cellulose-based paper, resin-coated papers such as photobase paper, papers made from or including polyethylene (PE), polypropylene (PP), polyethylene terephthalate (PET), and/or polylactic acid (PLA), etc.), a voltage of less than about 10 volts may be applied by the power supply V for the erasing process. In another example, the voltage applied ranges from about 1 V to about 10 V at a current ranging from about 5 mA to about 500 mA. In yet another example, the voltage applied ranges from about 1V to about 3V. In instances where the system 10 is used inside a printer, the voltage source V may be part of the power supply of the printer. However, in instances where the system 10 is used outside of the printer (e.g., as a standalone device), the system 10 may have to include its own power supply.

In another example, the system 10 depicted in FIG. 1 may be constructed using a conductive non-metal for the cathode wire 18 and the anode wire 20. The conductive non-metal includes, for example, a carbon-containing material. It has been found that the use of carbon-containing materials (e.g., graphite, etc.) may increase the efficiency of the erasing process, at least in part because the surface of carbon is very porous and electrocatalytic in nature. Some examples of carbon-containing materials include different forms of graphite such as carbon fibers, carbon felt, carbon foam, carbon powder, etc. The carbon-containing material may also be selected from carbon-containing materials having varying carbon compositions. In one example, the carbon-containing material includes from about 96% to about 99% carbon, and has a carbon density ranging from 0.05 g/cm$^3$ to about 1.5 g/cm$^3$. Further, the cathode wire 18 and anode wire 20 formed from the carbon-containing material may each be a single strand (e.g., as a single carbon fiber strand having an effective diameter ranging from about 10 microns to about 1000 microns) or may be a cable (e.g., multiple carbon fibers, e.g., woven, twisted, or braded together having an effective diameter ranging from about 1 mm to about 2 mm). The strand or cable is wound around the non-conductive support 26 in an alternating configuration, as previously described.

In some instances, the carbon-containing material may include metal particles chemically deposited on the surface thereof. Examples of metals that may be chemically deposited onto the carbon-containing material include platinum, titanium, nickel, titanium dioxide, silicon nitride, iron, silicon carbide, tantalum oxide, and/or combinations thereof.

It is to be understood that, in the example including the alternating carbon-containing anode and cathode strands or cables, the anode and the cathode may be specified based on how the electrical leads of the power supply V are connected to the strands/cables. In this case, when the positive (+) lead is connected to one of the strands/cables, that strand/cable is considered to be the anode (i.e., the strand/cable that is electron deficient). When the negative (−) lead is connected to the other of the strands/cables, the other strand/cable is considered to be the cathode (i.e., the strand/cable that is electron sufficient). In other words, due to the configuration of how the electrical leads of the power supply V are connected, one of the carbon-containing strands or cables (i.e., one of the electrodes) of the cell 16 is biased to be negatively charged, while the other carbon-containing strand or cable (i.e., the other electrode) is biased to be positively charged.

Another example of the system 10' is schematically shown in FIG. 2. In this example, the electrochemical cell 16' includes an anode 20' formed as a conductive or semi-conductive support having a non-conductive, porous membrane 28 disposed on the anode support 20', 26. The cathode 18 is a conductive or semi-conductive wire wound around the porous membrane 28 disposed on the anode support 20', 26. The electrochemical cell 16' shown in FIG. 2 is similar to a divided electrochemical cell.

In the instant example, the anode support 20', 26 may be constructed similarly to the non-conductive support 26 described above for FIG. 1; however, the anode support 20', 26 is formed from a conductive or semi-conductive material. Further, any of the conductive and semi-conductive materials described above of the anode wire 20 may also be used to form the anode support 20', 26. In an example, the length of the anode support 20', 26 is about the same as the length of a standard A size sheet of paper, such as about 8.5 inches (about 216 mm). The diameter the of the anode support 20', 26 may depend, at least in part, on the size of the application for which the system 10' is to be used. In an example, the diameter of the anode support 20', 26 ranges from about 20 mm to about 30 mm. In another example, the diameter of the anode support 20', 26 is about 25 mm.

The membrane 28 is formed from an inert, non-conductive material, and is porous so that fluid and ions can flow through the membrane 28 between the anode 20' and the cathode 18 during erasing. The membrane 28 may include a high density of pores, and these pores may vary in size from being relatively large to being relatively small, so long as the membrane 28 is either very permeable to water or other fluid (e.g., the erasure fluid 24) or very permeable to the flow of ions. In an example, the thickness and dielectric property/ies of the membrane 28 are such that membrane 28 effectively prevents the cathode wire 18 and the anode support 20', 26 from touching one another and creating a short circuit. The membrane 28 may take the form of a fabric or cloth, such as a TexWipe® cloth (available from ITW TexWipe™, Mahwah, N.J.). In an example, the membrane 28 may be relatively thin, such as having a thickness ranging from about 0.1 mm to about 0.25 mm.

In an example, the membrane 28 may take the form of a cationic or anionic membrane, such as NAFION® (available from E.I. duPont de Nemours & Co., Wilmington, Del.). It is believed that a charged membrane (i.e., anionic or cationic) contributes to the flow of electrons through the membrane 28 when a voltage is applied and current flows through the electrochemical circuit during the erasing process. The cationic or anionic membrane should be thin and flexible enough so that the membrane 28 may be wrapped around the anode support 20', 26. In an example, the membrane 28 has a thickness of about 0.25 mm or less, which may render the membrane 28 flexible enough to be wrapped around the anode support 20', 26.

The cathode wire 18 may be chosen from any of the cathode wires disclosed above in conjunction with the example system 10 in FIG. 1. The cathode wire 18 may be wound around the porous membrane 28, which is disposed on the anode support 20' as previously disclosed. In an example, the spacing $S_2$ between adjacent windings of the cathode wire 18 is desirably the same as the thickness of a single sheet of paper, or even smaller. It is to be understood that the electrochemical circuit will still operate effectively even if the windings of the cathode wire 18 touch, because the touching of the windings of the cathode wire 18 will not short out the circuit. It is further to be understood that some spacing between the windings of the cathode wire 18 is desirable, at least in part to provide a diffusion path for fluid and ions to flow during the erasing process.

Another example of the system 10" is schematically shown in FIG. 3. In this example, the electrochemical cell 16" has substantially the same configuration as the electrochemical cell 16' depicted in FIG. 2; however, the cathode 18' is provided as a conductive sheet disposed over the porous membrane 28. In one example, the cathode 18' is formed from a semi-conductive or conductive metal, electrolytic metal, and/or metal alloy, in the form of a thin film or foil. In an example, the thickness of the cathode film or foil 18' ranges from about 0.1 mm to about 0.25 mm. Further, the cathode film or foil 18' is perforated (shown by perforations P formed in the cathode film or foil 18' via, e.g., machining, cutting, or the like) to allow fluid and ions to flow during erasing.

The anode support 20', 26 in the example shown in FIG. 3 is also formed from a metal, an electrolytic metal, and/or a metal alloy, as previously described in the example shown in FIG. 2.

In another example, the cathode film 18' shown in FIG. 3 is formed from a semi-conductive or conductive carbon-containing material provided in the form of a piece of fabric or foam of varying densities and porosities, and this carbon-containing material is wrapped around a porous membrane 28 disposed on an anode support 20', 26 formed from another carbon-containing material. The carbon-containing materials may be chosen from any of the carbon-containing materials mentioned above in conjunction with one of the examples associated with the system 10 of FIG. 1. It is to be understood that, in this example, perforations do not have to be formed into the carbon-containing cathode film 18' because the carbon-containing material is already porous and thus fluid and ions already have a path for flow. Additionally, the carbon film is relatively flexible, and thus the cathode film 18' may be thicker for the carbon-containing material than for a metal, electrolytic metal, or metal alloy (which may not be as flexible as the carbon-containing material). Thus, in an example, the thickness of the carbon-containing cathode film 18' is at least 0.1 mm, and may be larger than 0.25 mm. Further, in the instant example, the anode 20' and the cathode 18' are determined by the configuration of the electrical leads, where the negative (−) lead is connected to the cathode 18' and the positive (+) lead is connected to the anode 20'.

For the example systems 10', 10" shown in FIGS. 2 and 3, respectively, in an example, the anode and the cathode may be reversed. For instance, the system 10', 10" may be configured to include a cathode support having a porous membrane disposed thereon, and an anode wire wound around the porous membrane (system 10') or an anode sheet wrapped around the porous membrane (system 10"). In this case, the polarity of the power supply V would have to be reversed in order to establish the desired current flow for the electrochemical circuit.

Examples of a method of making the systems 10, 10', and 10" will now be described herein. One example method includes directly coating the surface 22 of the medium 14 with the erasure fluid 24, and then positioning the coated medium 14 onto the inert base 12. The electrochemical cell 16, 16', 16" is created and placed adjacent the medium 14. In the example shown in FIG. 1, for instance, the electrochemical cell 16 may be created by winding the cathode wire 18 and the anode wire 20 around the non-conductive support 26 in an alternating configuration, and then connecting the positive (+) electrical lead of the power supply V to the anode wire 20 and the negative (−) electrical lead to the cathode wire 18. The electrochemical cell 16 is placed adjacent to a single surface (e.g., the surface 22) of the medium 14 supported on the inert base 12. In the examples shown in FIGS. 2 and 3, the electrochemical cell 16', 16" may be created by disposing the porous membrane 28 onto the anode support 20', and then winding the cathode wire 18 around (FIG. 2), or placing a cathode sheet or fabric 18' on (FIG. 3) the porous membrane 28. Thereafter, the positive (+) electrical lead of the power supply V is connected to the anode support 20', and the negative (−) electrical lead is connected to the cathode wire 18/cathode fabric 18'. The electrochemical cell 16', 16" is placed adjacent to the medium 14 supported on the inert base 12.

In one case, the electrodes of the cell 16, 16', 16" (i.e., the anode and the cathode) are placed in direct contact with the fluid 24 coated on the surface 22 of the medium 14. In another case, the electrodes of the cell 16, 16', 16" may be placed a small distance from the fluid 24 coated on the surface 22 of the medium 14 (e.g., a distance that is far enough away so that the electrodes and the fluid are no longer physically touching, but not so far away that an electrochemical circuit cannot be completed). After the cell 16, 16', 16" has been placed in the desired position, the electrodes of the cell 16, 16', 16" are connected to the power supply V using electrical leads.

In another example method, the surface 22 of the medium 14 is indirectly coated with the erasure fluid 24. In this example, the erasure fluid 24 is applied directly to the electrode(s) of the electrochemical cell 16, 16', 16", and then the fluid is transferred to the medium 14 when the cell 16, 16', 16" is created. Thereafter, the electrodes of the cell 16, 16', 16" are connected to the power supply V using electrical leads.

Other examples of the system disclosed herein will now be described in conjunction with FIGS. 4 through 6. This system 100, 100', 100" includes an electrochemical cell that is constructed so that the medium having the erasable inkjet ink established thereon is sandwiched between two opposed electrodes, and thus a voltage would have to be applied through the medium. For instance, one of the electrodes (e.g., the anode) is positioned adjacent to one of the surfaces 22, 23 of the medium 14, while the other electrode (e.g., the cathode) is positioned adjacent to the other surface 22, 23 of the medium 14. Further, the systems 100, 100', 100" utilize carbon-containing materials for the opposed electrodes (i.e., the cathode and the anode), examples of which are provided above in conjunction with one of the examples associated with the system 10 of FIG. 1.

In the example shown in FIG. 4, the electrodes (i.e., the anode 20" and the cathode 18") are both provided in the form of a brush which includes a base portion and a plurality of individual carbon-containing fibers extending from the base portion. As shown in FIG. 4A, which is an enlarged view of a portion of FIG. 4, each carbon-containing fiber 32 of the cathode brush 18" has a diameter d ranging from about 10 microns to about 2 mm, and the density of the fibers 32 may vary. The carbon-containing fibers of the anode brush 20" are identified by reference numeral 34 in FIG. 4, and these fibers 34 may have the same diameter and density/ies. The brushes 18", 20" are situated so that the fibers 32 of the cathode 18" face toward the surface 23 of the medium 14, and the fibers 34 of the anode 20" face toward the surface 22 of the medium 14. The brushes are commercially available as carbon fiber record brushes, such as those available from AudioQuest (Irvine Calif.) and Pro-Ject Audio Systems (Vienna, Austria). The purchased brushes may be wired with electrical connectors configured to receive the electrical leads of the power supply V. These brushes may also be custom made to meet required specifications.

Another example of the system 100' is schematically shown in FIG. 5. In this example, the system 100' includes a cathode strand or cable 18 formed of a carbon-containing material wrapped around a non-conductive support 26, and an anode strand or cable 20 formed from a carbon-containing material wrapped around its own non-conductive support 26. The cathode 18 and the anode 20 are positioned so that they oppose each other, and the medium 14 is sandwiched between them. Examples of the cathode strand or cable 18, the anode strand or cable 20, and the non-conductive support 26 are described above in conjunction with the system 10 associated with FIG. 1.

Figure 6:
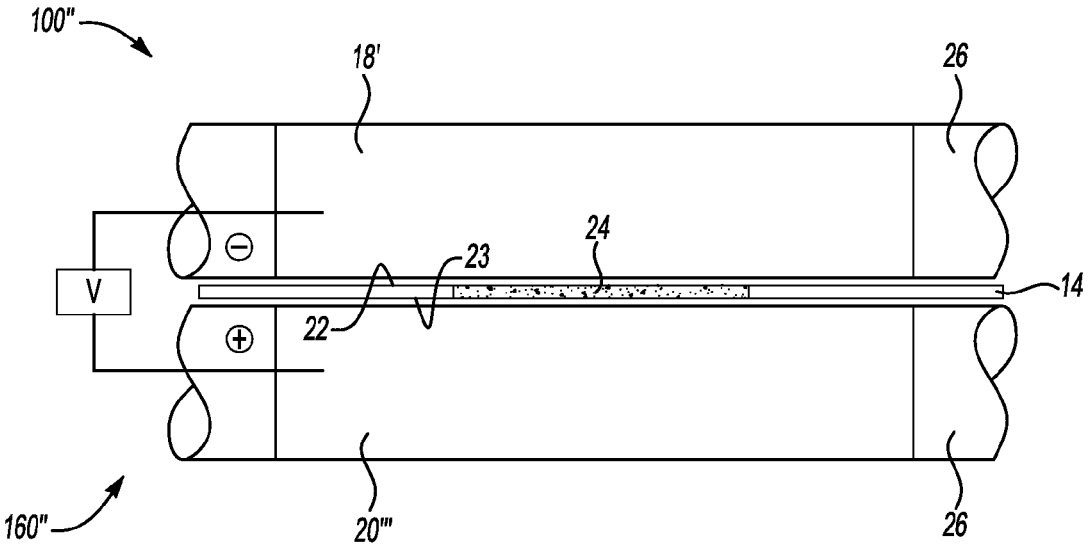

Yet another example of the system 100" schematically shown in FIG. 6 includes a cathode fabric, foil, sheet, fibers, or the like 18' disposed on, or wrapped around a non-conductive support 26, and an anode fabric, foil, sheet, fibers, or the like 20''' disposed on, or wrapped around a separate non-conductive support 26. The cathode 18' and the anode 20''' are opposed to each other, having the medium 14 sandwiched between them. Examples of the cathode 18' and the non-conductive support 26 are described above in conjunction with the system 10 associated with FIG. 1. Further, examples of the anode fabric, foil, sheet, fibers, or the like 20''' include any of the examples mentioned above for the cathode fabric, foil, sheet, fibers, or the like.

A method of making the systems 100, 100', and 100" will now be described herein. For all of the systems 100, 100', 100", the method involves either directly or indirectly applying the erasure fluid 24 to the medium 14 such that the erasure fluid 24 penetrates through the thickness of the medium 14. The electrochemical cell 160, 160', 160" is created by positioning the anode adjacent to one side of the medium 14 (e.g., adjacent to the surface 22) and positioning the cathode adjacent to an opposed side of the medium (e.g., the surface 23) such that the medium 14 is sandwiched between the anode and the cathode. In the example shown in FIG. 4, the electrochemical cell 100 may be created by making the anode and cathode brushes. This may be accomplished by purchasing the brushes, and then providing a conductive pathway through the carbon fibers or bristles of the brush using conductive metal clamps or tape. Once the brushes are made, and the electrochemical cell is assembled, the method further involves connecting the positive (+) electrical lead of the power supply V to the anode brush 20" and the negative (−) electrical lead to the cathode brush 18".

In the examples shown in FIGS. 5 and 6, the electrochemical cell 16 may be created by winding the cathode strand/cable 18, or wrapping the cathode fabric, etc. 18' around one of the non-conductive supports 26, and then winding the anode strand/cable 20, or wrapping the anode fabric, etc. 20''' around the other non-conductive support 26. The method then includes connecting the positive (+) electrical lead of the power supply V to the anode strand/cable 20 or the anode fabric 20''' and the negative (−) electrical lead to the cathode strand/cable 18 or the cathode fabric 18'.

Figure 7:
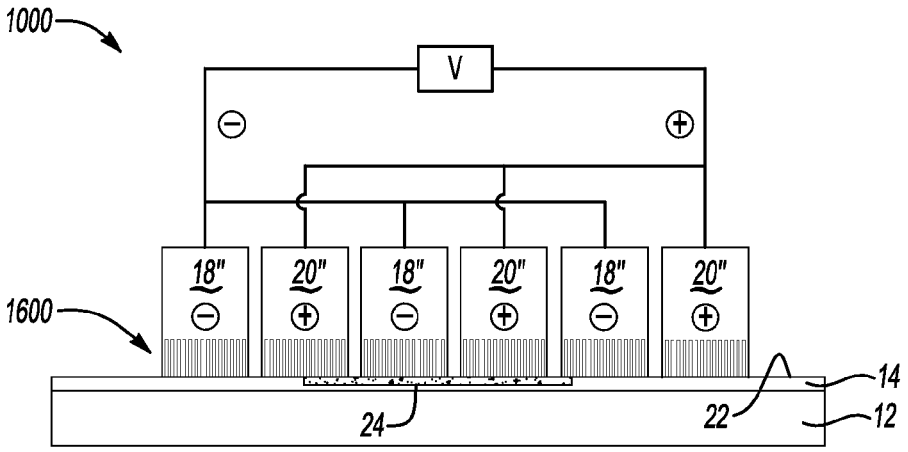
FIG. 7 is an end view schematically depicting an example of yet another example of a system for erasing an ink from a medium.

Yet another example system 1000 is schematically depicted in FIG. 7. This system 1000 is shown as an end view, and the system 1000 includes an electrochemical cell 1600 created from alternating carbon-containing cathode 18" and anode 20" brushes. The alternating brushes 18", 20" are shown situated next to one another adjacent to a single surface (e.g., the surface 22) of the medium 14. The cathode brush 18" and the anode brush 20", in this configuration, are separated from each other by enough distance so that the cathode 18" and the anode 20" do not touch each other and short out the circuit. The alternating cathode 18" and the anode 20" are connected to a power supply V using electrical leads.

It is to be understood that the ranges provided herein include the stated range and any value or sub-range within the stated range. For example, an amount ranging from about 10 microns to about 1000 microns should be interpreted to include not only the explicitly recited amount limits of about 10 microns to about 1000 microns, but also to include individual amounts, such as 100 microns, 500 microns, 850 microns, etc., and subranges, such as 50 microns to 600 microns, etc. Furthermore, when "about" is utilized to describe a value, this is meant to encompass minor variations (up to +/−5%) from the stated value.

It is further to be understood that, as used herein, the singular forms of the articles "a," "an," and "the" include plural references unless the content clearly indicates otherwise.

Additionally, the term "any of", when used in conjunction with lists of components or elements (e.g., the factors that the spacing between alternating cathode and anode wires may depend on) refers to one of the components/elements included in the list alone or combinations of two or more components/elements. For instance, the term "any of", when used with reference to the factors that the spacing depends on, includes i) thickness of the cathode wire and the anode wire alone, ii) gauge of the cathode wire and the anode wire alone, iii) or combinations of the two.

While several examples have been described in detail, it will be apparent to those skilled in the art that the disclosed examples may be modified. Therefore, the foregoing description is not to be considered limiting.

What is claimed is:

1. A system for erasing an ink from a medium, comprising:

the medium having the ink printed on a surface thereof, and an liquid erasure fluid directly or indirectly applied to the surface;

an inert base upon which the medium is placed; and an electrochemical cell, including:

a cathode and an anode, both positioned adjacent the surface of the medium having the ink printed thereon; and a power source to apply a voltage across the medium.

2. The system as defined in claim 1 wherein the cathode and the anode are individually conductive wires wound around a non-conductive support in an alternating configuration.

3. The system as defined in claim 2 wherein the cathode wire and the anode wire, when wound around the non-conductive support, are spaced from about 0.01 mm to about 1 mm apart depending upon any of a thickness or gauge of the cathode wire and the anode wire.

4. The system as defined in claim 1 wherein the anode is a conductive support having a porous membrane disposed thereon, and the cathode is a wire wrapped around the conductive support over the porous membrane.

5. The system as defined in claim 1 wherein each of the anode and the cathode are formed from a semi-conductive or conductive carbon-containing material.

6. The system as defined in claim 5 wherein the carbon-containing material is provided in the form of a strand or a cable, and wherein the carbon-containing strand or cable is wound around a non-conductive support.

7. The system as defined in claim 6 wherein the carbon-containing strand has an effective diameter ranging from about 10 microns to about 1000 microns, and wherein the carbon-containing cable has an effective diameter ranging from about 1 mm to about 2 mm.

8. The system as defined in claim 5 wherein the carbon-containing material is provided in the form of a piece of fabric or a foam, and wherein the carbon-containing material is wrapped around a non-conductive support.

9. The system as defined in claim 1 wherein the cathode and the anode are individually brushes formed from a carbon-containing material, the brushes being situated in an alternating configuration adjacent the surface of the medium.

10. A method of making the system of claim 1, comprising:

coating the surface of the medium having the ink printed thereon with the liquid erasure fluid, the coating being accomplished directly or indirectly;

positioning the coated medium onto an inert base; and creating the electrochemical cell by:

positioning an anode and a cathode adjacent the surface of the medium having the ink printed thereon; and connecting the anode and the cathode to a power supply.

11. The method as defined in claim 10 wherein the liquid erasure fluid is indirectly applied to the surface of the medium by:

coating the liquid erasure fluid on a surface of the cathode and the anode; and transferring the liquid erasure fluid transfers from the surface of the cathode and the anode to the surface of the medium when the cathode and the anode contact the medium.

12. The method as defined in claim 10, further comprising:

applying a voltage between the cathode and the anode to facilitate or assist a chemical reaction between a colorant in the ink and an erasure component in the liquid erasure fluid, thereby changing and de-colorizing the colorant.

13. The system as defined in claim 1 wherein:

the ink includes a colorant that chemically reacts with an erasure component of the liquid erasure fluid;

the electrochemical cell facilitates or assists a chemical reaction between the colorant and the erasure component; and as a result of the chemical reaction, the colorant changes and de-colorizes.

* * * * *